US010674819B2

(12) United States Patent
Chen et al.

(10) Patent No.: US 10,674,819 B2
(45) Date of Patent: Jun. 9, 2020

(54) SLIDE RAIL MECHANISM AND ADJUSTING FOR SLIDE RAIL

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Shih-Lung Huang, Kaohsiung (TW); Fang-Cheng Su, Kaohsiung (TW); Ci-Bin Huang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 191 days.

(21) Appl. No.: 15/921,787

(22) Filed: Mar. 15, 2018

(65) Prior Publication Data

US 2019/0059584 A1 Feb. 28, 2019

(30) Foreign Application Priority Data

Aug. 31, 2017 (TW) ..... 106130065 A

(51) Int. Cl.
*A47B 88/427* (2017.01)

(52) U.S. Cl.
CPC .... *A47B 88/427* (2017.01); *A47B 2210/0054* (2013.01); *A47B 2210/0056* (2013.01); *A47B 2210/091* (2013.01)

(58) Field of Classification Search
CPC ..... A47B 88/427; A47B 88/407; A47B 2088/4272; A47B 2088/4274; A47B 2088/4278; A47B 2210/0054; A47B 2210/0056; A47B 2210/091
See application file for complete search history.

(56) References Cited

U.S. PATENT DOCUMENTS

| | | | | |
|---|---|---|---|---|
| 8,220,884 | B2 | 7/2012 | Berger | |
| 8,585,165 | B2 | 11/2013 | Liang et al. | |
| 8,857,929 | B2 * | 10/2014 | Netzer | A47B 88/427 312/334.5 |
| 8,870,313 | B2 * | 10/2014 | Grabherr | A47B 88/427 312/334.5 |

(Continued)

FOREIGN PATENT DOCUMENTS

| | | | |
|---|---|---|---|
| DE | 202006003035 | U1 | 7/2007 |
| EP | 3085270 | * | 10/2016 |
| WO | WO2016174025 | A1 | 11/2016 |

*Primary Examiner* — Daniel J Troy
*Assistant Examiner* — Timothy M Ayres
(74) *Attorney, Agent, or Firm* — Alan D. Kamrath; Karin L. Williams; Mayer & Williams PC

(57) ABSTRACT

An adjusting mechanism for slide rail includes a first adjusting device, a second adjusting device and a housing. The first adjusting device includes a first base and a first adjusting member configured to adjust a height of the first base. The second adjusting device includes a second base and a second adjusting member configured to adjust the second base to move transversely relative to the second rail. The first adjusting device and the second adjusting device are mounted to the housing. Wherein, the second base includes a base part and a protrusion part. The protrusion part is fixed to the base part and configured to be inserted into a carried object supported by the slide rail.

18 Claims, 8 Drawing Sheets

(56) References Cited

U.S. PATENT DOCUMENTS

| | | | | |
|---|---|---|---|---|
| 9,066,587 | B1 | 6/2015 | Liang et al. | |
| 9,149,116 | B2 | 10/2015 | Gasser | |
| 10,244,867 | B2 * | 4/2019 | Liang | A47B 88/427 |
| 2001/0019235 | A1 * | 9/2001 | Hammerle | A47B 88/407<br>312/334.4 |
| 2012/0080988 | A1 | 4/2012 | Greussing | |
| 2012/0176015 | A1 | 7/2012 | Liang et al. | |
| 2014/0314347 | A1 | 10/2014 | Huang | |
| 2016/0025124 | A1 | 1/2016 | Roedder et al. | |

* cited by examiner

SLIDE RAIL MECHANISM AND ADJUSTING FOR SLIDE RAIL

BACKGROUND OF THE INVENTION

1. Field of the Invention

The present invention relates to a slide rail mechanism, and more particularly, to a slide rail mechanism with an adjusting assembly.

2. Description of the Prior Art

Generally, a slide rail assembly is configured to assist in opening or closing a furniture part relative to another furniture part. With improvement of related technologies in the slide rail industry, an undermount drawer slide has been developed in the current market. Such undermount drawer slide can be mounted to a bottom of a drawer, such that, the undermount drawer slide can be hidden under the bottom of the drawer without being exposed while the drawer is pulled out of a cabinet.

In the related prior art, U.S. Pat. No. 8,585,165 B2 discloses a device for adjusting height of drawer. The device comprises a base (10), a supporting seat (12), an adjusting member (14), a screw rod (16) and a connecting member (18). Wherein, a first end (20) of the base (10) is connected to a rear portion of a guide rail (52), and a second end (22) of the base (10) is connected to the supporting seat (12). Furthermore, through operating the adjusting member (14) to rotate relative to the screw rod (16), a height of the supporting seat (12) can be changed, such that an angle of the drawer can be changed through the connecting member (18) which is connected to the drawer.

However, for different market requirements, it is important to develop various products with different adjusting mechanisms for a carried object on a slide rail.

SUMMARY OF THE INVENTION

The present invention relates to a slide rail mechanism, and more particularly, to a slide rail mechanism with an adjusting assembly.

According to an embodiment of the present invention, a slide rail mechanism comprises a slide rail, a housing, a first adjusting device and a second adjusting device. The slide rail comprises a front part and a rear part. The housing is connected between the front part and the rear part of the slide rail. The first adjusting device is mounted to the housing. The first adjusting device comprises a first base and a first adjusting member. The second adjusting device is mounted to the housing. The second adjusting device comprises a second base and a second adjusting member. Wherein, the first base comprises a first part and a second part connected to the first part, and the first part and the second part are extended along a longitudinal direction of the slide rail. Wherein, the first part is fixed relative to the slide rail, and the first adjusting member is configured to adjust an inclination angle of the second part relative to the slide rail. Wherein, the second adjusting member is configured to adjust the second base to transversely move relative to the slide rail. The second base comprises a base part and a protrusion part. The protrusion part is fixed to the base part. The protrusion part is configured to be inserted into a mounting feature of a carried object on the slide rail.

Preferably, the first base further comprises an extension wall substantially perpendicularly connected to the second part. The first adjusting member comprises a main body part and an eccentric part. The main body part and the eccentric part are not concentric. The eccentric part is mounted to the extension wall.

Preferably, the extension wall, the second part and the first part of the first base are integrally formed in one piece.

Preferably, the first part and the second part of the first base are integrally formed in one piece.

Preferably, the first base is made of a flexible material.

Preferably, the second base has a first adjusting structure corresponding to a second adjusting structure of the second adjusting member, in order to allow the second adjusting member to adjust the second base to move transversely.

Preferably, the first adjusting structure and the second adjusting structure are screw structures screwed to each other.

Preferably, the housing is connected to the slide rail and adjacent to the rear part of the slide rail.

According to another embodiment of the present invention, an adjusting assembly comprises a first adjusting device, a second adjusting device and a housing. The first adjusting device comprises a first base and a first adjusting member configured to operatively move the first base for adjusting a height of the first base. The second adjusting device comprises a second base and a second adjusting member configured to adjust the second base to move transversely relative to the first base. The first adjusting device and the second adjusting device are mounted to the housing. Wherein, the second base comprises a base part and a protrusion part. The protrusion part is fixed to the base part. The protrusion part is arranged along a longitudinal direction of the first base.

Preferably, the protrusion part has a first supporting section. The base part has a second supporting section configured to abut against the first supporting section.

Preferably, the housing has a first guiding feature. The second base has a second guiding feature mounted to the first guiding feature.

Preferably, one of the first guiding feature and the second guiding feature is a rib, and the other one of the first guiding feature and the second guiding feature is an elongated hole or an elongated groove.

According to another embodiment of the present invention, a slide rail mechanism is applicable to a furniture part. The slide rail mechanism comprises a first rail, a second rail and a first adjusting device. The second rail is longitudinally movable relative to the first rail. The second rail is configured to support the furniture part, and comprises a front part and a rear part. The first adjusting device is adjacent to the rear part of the second rail. The first adjusting device comprises a first base and a first adjusting member. Wherein, the first base comprises a first port and a second part connected to the first part. Wherein, the first part is fixed relative to the second rail, and the second part is configured to support a bottom of the furniture part. Wherein, the first adjusting member is configured to adjust an inclination angle of the second part relative to the second rail.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
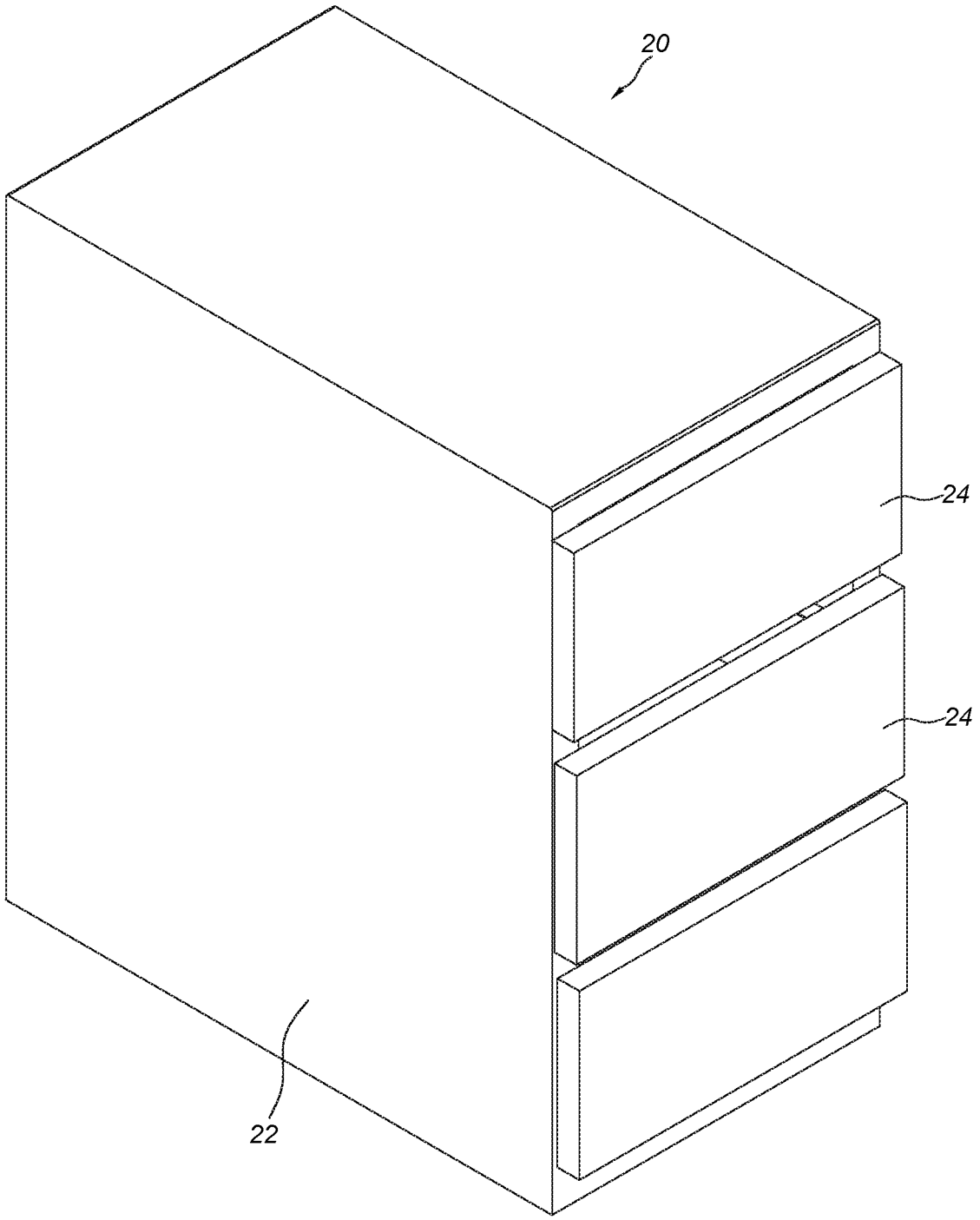
FIG. 1 is a diagram showing a furniture system comprising a cabinet and drawers according to an embodiment of the present invention.

As shown in FIG. 1, a furniture system 20 comprises a first furniture part and a second furniture part. In the present embodiment, the furniture system 20 comprises a cabinet 22 and at least one drawer 24. Wherein, the drawer 24 can be retracted relative to the cabinet 22.

Figures 2, 3, 4:
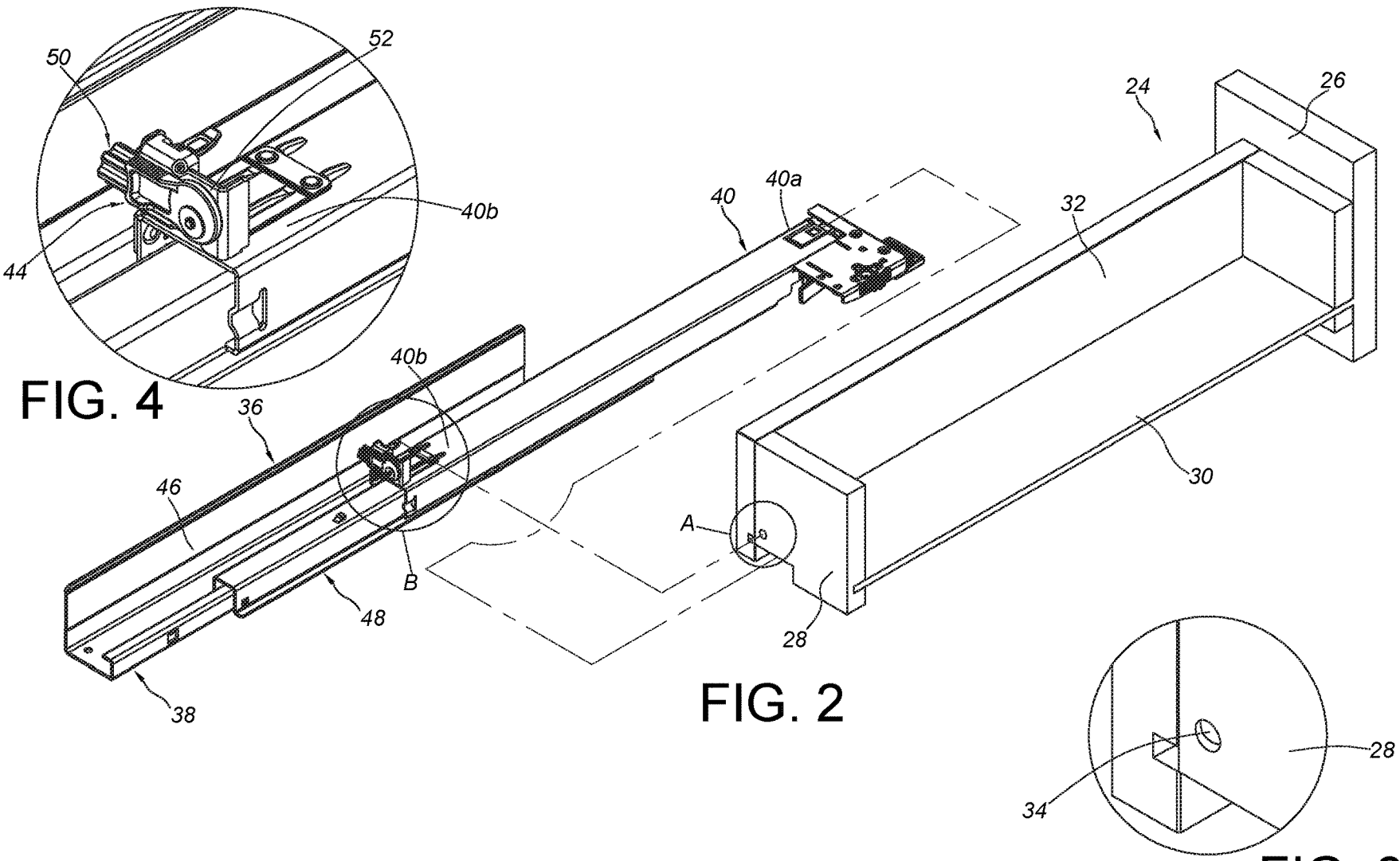
FIG. 2 is an exploded view of the drawer and a slide rail mechanism of the furniture system according to an embodiment of the present invention.
FIG. 3 is an enlarged view of an area A of FIG. 2.
FIG. 4 is an enlarged view of an area B of FIG. 2.

As shown in FIG. 2, the drawer 24 (FIG. 2 only shows a portion of the drawer 24) comprises a front wall 26 (such as a front panel), a rear wall 28, a bottom 30 and a side wall 32. As shown in FIG. 3, the rear wall 28 of the drawer 24 has a mounting feature, such as a mounting hole 34. In an embodiment of the present invention, a slide rail mechanism 36 is applicable to a furniture part, such as the drawer 24. Specifically, the slide rail mechanism 36 comprises a first rail 38, a second rail 40 and a first adjusting device 44 (as shown in FIG. 4).

The first rail 38 is fixed to a target object through an extension section 46. For example, the extension section 46 is fixed to the cabinet 22 by screwing. The second rail 40 is arranged along a longitudinal direction of the first rail 38, and is longitudinally movable relative to the first rail 38. The second rail 40 comprises a front part 40*a* and a rear part 40*b*. Preferably, the slide rail mechanism 36 further comprises a third rail 48 movably mounted between the first rail 38 and the second rail 40 for extending a traveling distance of the second rail 40 relative to the first rail 38.

As shown in FIG. 2 and FIG. 4, the first adjusting device 44 is located between the front part 40*a* and the rear part 40*b* of the second rail 40. In the present embodiment, the first adjusting device 44 is arranged adjacent to the rear part 40*b* of the second rail 40. Preferably, the slide rail mechanism 36 further comprises a second adjusting device 50 and a housing 52. The housing 52 is connected to the second rail 40. For example, the housing 52 is connected to the second rail 40 and adjacent to the rear part 40*b* of the second rail 40. The first adjusting device 44 and the second adjusting device 50 are mounted to the housing 52. Wherein, the first adjusting device 44, the second adjusting device 50 and the housing 52 form an adjusting assembly.

Figure 5:
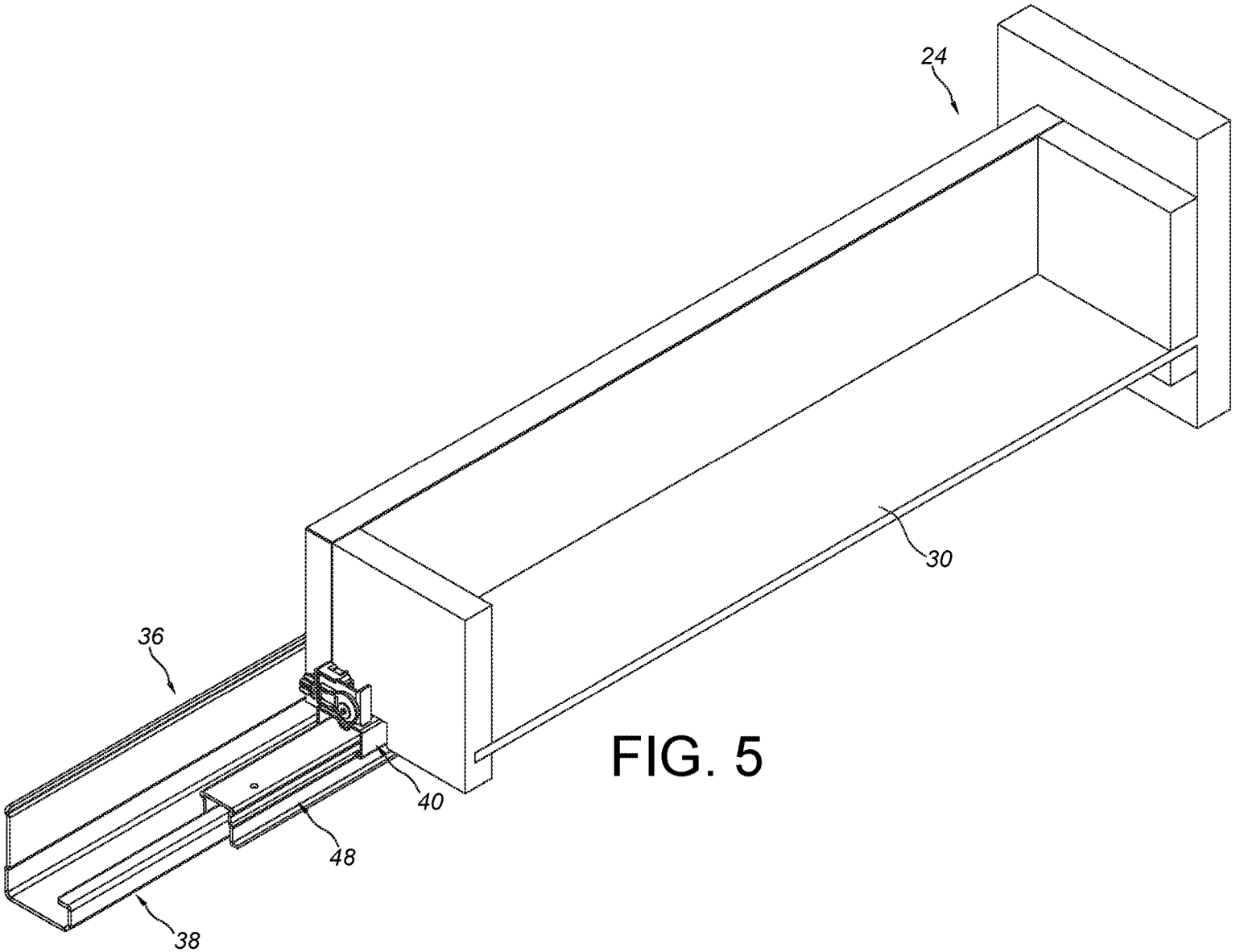
FIG. 5 is a diagram showing an installation relationship between the drawer and the slide rail mechanism of the furniture system according to an embodiment of the present invention.

FIG. 5 is a diagram shoving an installation relationship between the drawer 24 and the slide rail mechanism 36. The bottom 30 of the drawer 24 is supported by the second rail 40. Wherein, since the second rail 40 is movable relative to the first rail 38, the drawer 24 can be moved relative to the cabinet 22 from a retracted state to an open state.

Figure 6:
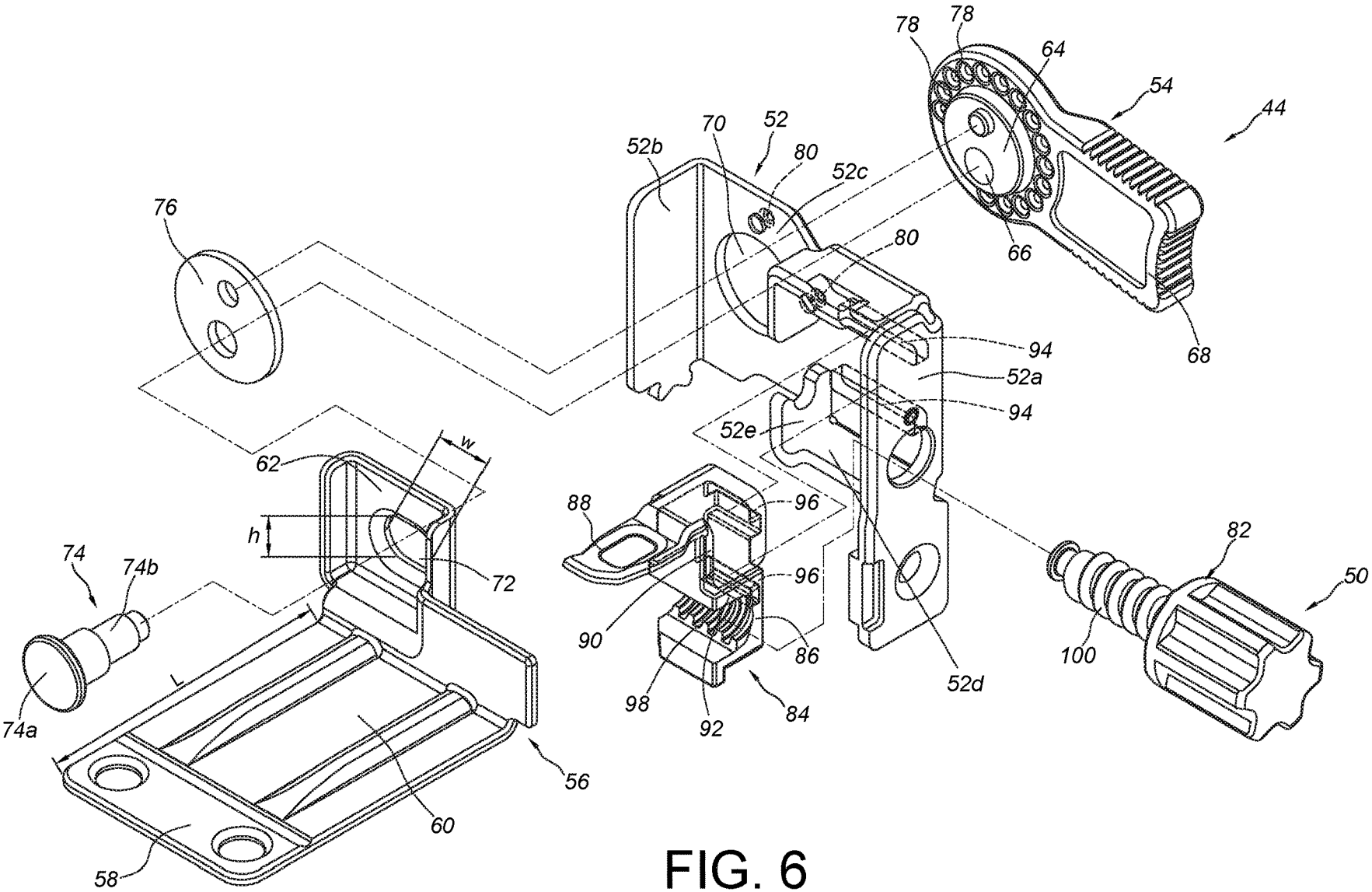
FIG. 6 is an exploded view of an adjusting assembly according to an embodiment of the present invention.
Figure 7:
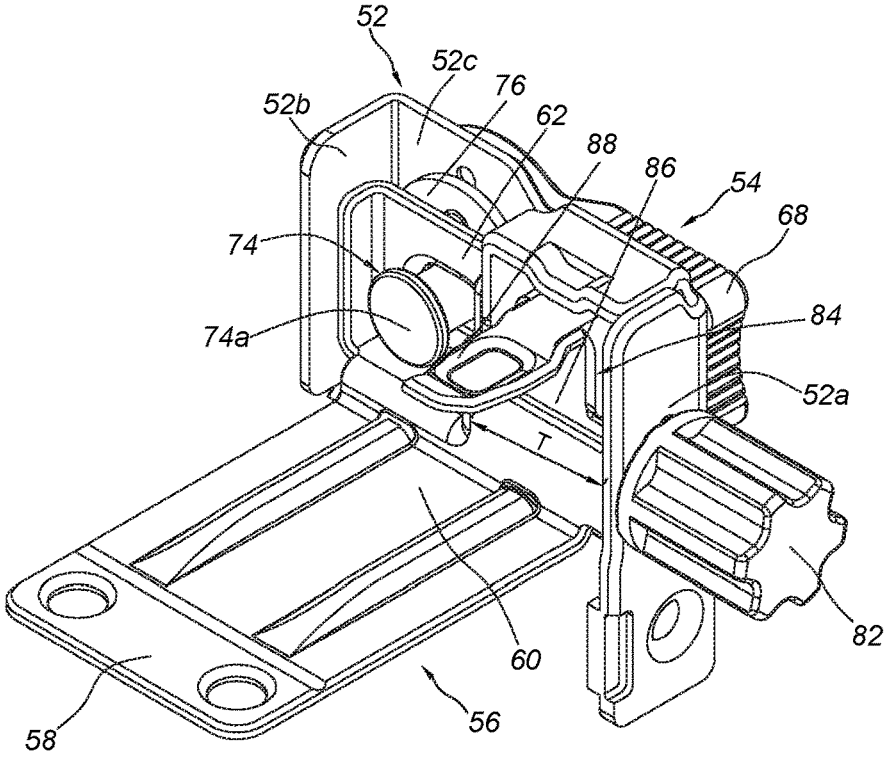
FIG. 7 is a diagram showing the adjusting assembly in one specific angle according to an embodiment of the present invention.

As shown in FIG. 6 and FIG. 7, the housing 52 comprises a plurality of parts configured to mount the first adjusting device 44 and the second adjusting device 50. For example, the housing 52 comprises a first side plate 52*a*, a second side plate 52*b*, a middle plate 52*c* connected between the first side plate 52*a* and the second side plate 52*b*, and a bottom plate 52*d* extended from a bottom of the middle plate 52*c*. Preferably, the housing 52 further comprises a spacing plate 52*e* substantially perpendicularly connected to the bottom plate 52*d*.

The first adjusting device 44 comprises a first adjusting member 54 and a first base 56. The first adjusting member 54 is configured to adjust the first base 56.

Specifically, the first base 56 comprises a first part 58 and a second part 60. The second part 60 is connected to the first part 58. Preferably, the first part 58 and the second part 60 are integrally formed in one piece. For example, the first part 58 and the second part 60 form a supporting plate which has a length L. A longitudinal direction of the supporting plate is substantially identical to a longitudinal direction (or a longitudinally moving direction) of the second rail 40. In other words, the first part 58 and the second part 60 are extended along the longitudinal direction of the second rail 40. Preferably, the first base 56 further comprises an extension wall 62 substantially perpendicularly connected to the second part 60. Preferably, the extension wall 62, the second part 60 and the first part 58 are integrally formed in one piece. Preferably, the first base 56 is flexible. For example, the first base 56 is made of metal or plastic.

The first adjusting member 54 comprises a main body part 64, an eccentric part 66 and an operating part. 68. The main body part 64 is substantially in a circular shape. The eccentric part 66 is arranged on the main body part 64. The eccentric part 66 and the main body part 64 have different circle centers (not concentric). The main body part 64 can penetrate through an opening 70 of the middle plate 52*c* of the housing 52, in order to allow the eccentric part 66 to be mounted to the extension wall 62 of the first base 56, such that the first base 56 can be adjusted to move by the first adjusting member 54.

Preferably, the extension wall 62 of the first base 56 has a connecting hole 72 corresponding to the eccentric part 66 of the first adjusting member 54. A width w of the connecting hole 72 is slightly greater than an outer diameter of the eccentric part 66 of the first adjusting member 54. In the present embodiment, the connecting hole 72 can be an elongated hole. Preferably, a connecting member 74 can be arranged on the extension wall 62 of the first base 56 by passing through the connecting hole 72. The connecting member 74 has a first connecting part 74*a* and a second connecting part 74*b* connected to the first connecting part 74*a*. An outer diameter of the first connecting part 74*a* is greater than a height h of the connecting hole 72, such that the first connecting part 74*a* is located outside the connecting hole 72 while being mounted to the first base 56. An outer diameter of the second connecting part 74*b* is smaller than the height h of the connecting hole 72, such that the second connecting part 74*b* can penetrate through the connecting hole 72 to be connected to the eccentric part 66 of the first adjusting member 54. The operating part 68 is connected to the main body part 64.

Preferably, after the main body part 64 penetrating through the opening 70 of the housing 52, the main body part 64 can be further connected to the second connecting part 74*b* of the connecting member 74 through a mounting plate 76. Wherein, the mounting plate 76 is slightly larger than the main body part 64, and the mounting plate 76 is arranged between the main body part 64 and the extension wall 62.

Preferably, at least one first feature 78 and at least one second feature 80 corresponding to the at least, one first feature 78 are arranged between the main body part 64 of the first adjusting member 54 and the housing 52. In the present embodiment, a plurality of first features 78 are arranged on a periphery of the main body part 64, and two second features 80 are arranged on the middle plate 52*c* of the housing 52. The first features 78 and the second features 80 can be a combination of concave and convex structures, or a combination of convex and concave structures. When the first adjusting member 54 is adjusted to rotate, one of the plurality of first features 78 can be engaged with the second feature 80, such that the first adjusting member 54 can be temporarily positioned relative to the housing 52 after rotation.

On the other hand, the second adjusting device 50 comprises a second adjusting member 82 and a second base 84. The second adjusting member 82 is configured to adjust the second base 84 to move along a transverse direction T relative to the second rail 40 or the first base 56. In other words, the second adjusting member 82 can adjust a transverse position of the second base 84. Preferably, the second base 84 is flexible. For example, the second base 84 is made of metal or plastic.

Figure 9:
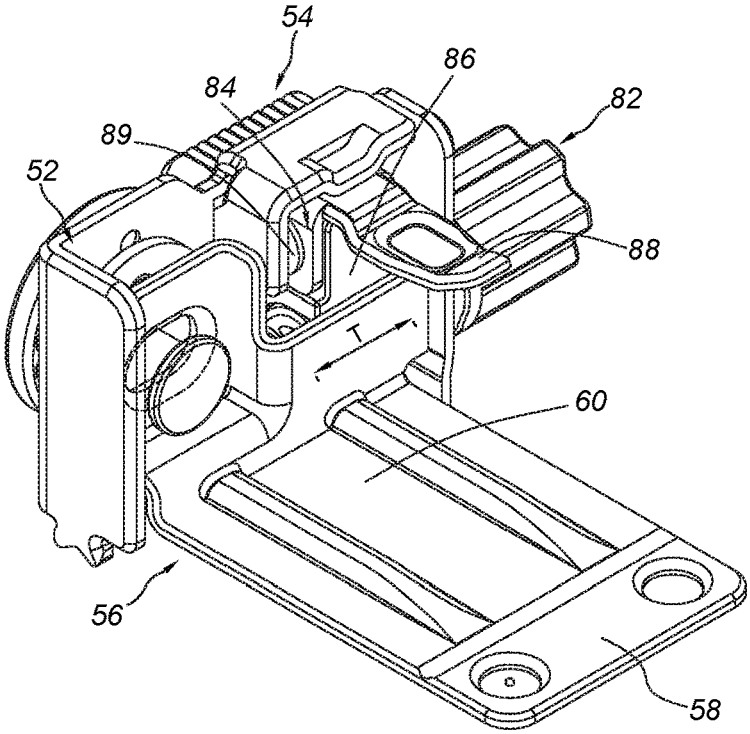
FIG. 9 is a diagram showing the adjusting assembly in another angle according to an embodiment of the present invention.

Specifically, the second base 84 comprises a base part 86 and a protrusion part 88. The protrusion part 88 is fixed relative to the base part 86. The protrusion part 88 is arranged along a longitudinal direction of the first base 56. For example, the protrusion part 88 can be riveted to the base part 66 by a rivet 89 (as shown in FIG. 9), but the preset invention is not limited thereto. Preferably, the protrusion part 88 is fixed to the base part 86. Preferably, the protrusion part 88 has a first supporting section 90, and the base part 86 has a second supporting section 92 configured to abut against the first supporting section 90. Wherein, since the protrusion part 88 is fixed relative to the base part 86, the protrusion part 88 and the base part 86 can be seen as one component. Preferably, the second base 84 is located within a space defined by the first side plate 52*a*, the bottom plate 52*d* and the spacing plate 52*e* of the housing 52. Preferably, the housing 52 comprises a first guiding feature 94, and the second base 84 has a second guiding feature 96 mounted to the first guiding feature 94. Preferably, one of the first guiding feature 94 and the second guiding feature 96 is a rib, and the other one of the first guiding feature 94 and the second guiding feature 96 is an elongated hole or an elongated groove. Through arrangement of the first guiding feature 94 and the second guiding feature 96, the second base 84 can be moved along the transverse direction T.

The second adjusting member 82 can be operatively connected to the second base 84. The second base 84 (the base part 86) and the second adjusting member 82 respectively have a first adjusting structure 98 and a second adjusting structure 100 corresponding to each other.

For example, the first adjusting structure 98 and the second adjusting structure 100 are screw structures screwed to each other. Through interaction between the first adjusting structure 98 and the second adjusting structure 100, the second adjusting member 82 can adjust the second base 84 to move along the transverse direction T.

Figure 8:
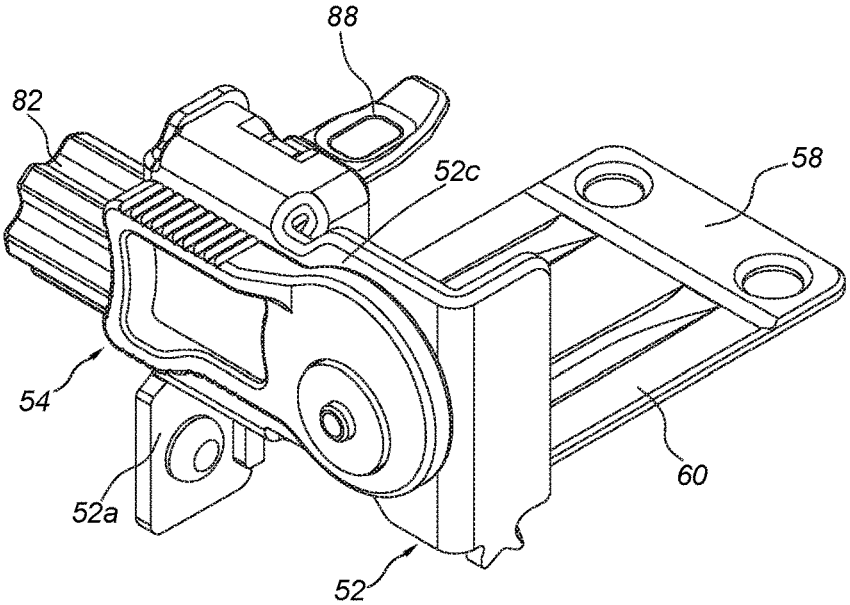
FIG. 8 is a diagram showing the adjusting assembly in another angle according to an embodiment of the present invention.

As shown in FIG. 7 and FIG. 8, the first adjusting member 54 is arranged at a rear side of the middle plate 52*c* of the housing 52. On the other hand, the protrusion part 88 of the second base 84 extends to be in front of the middle plate 52*c*.

Figure 10:
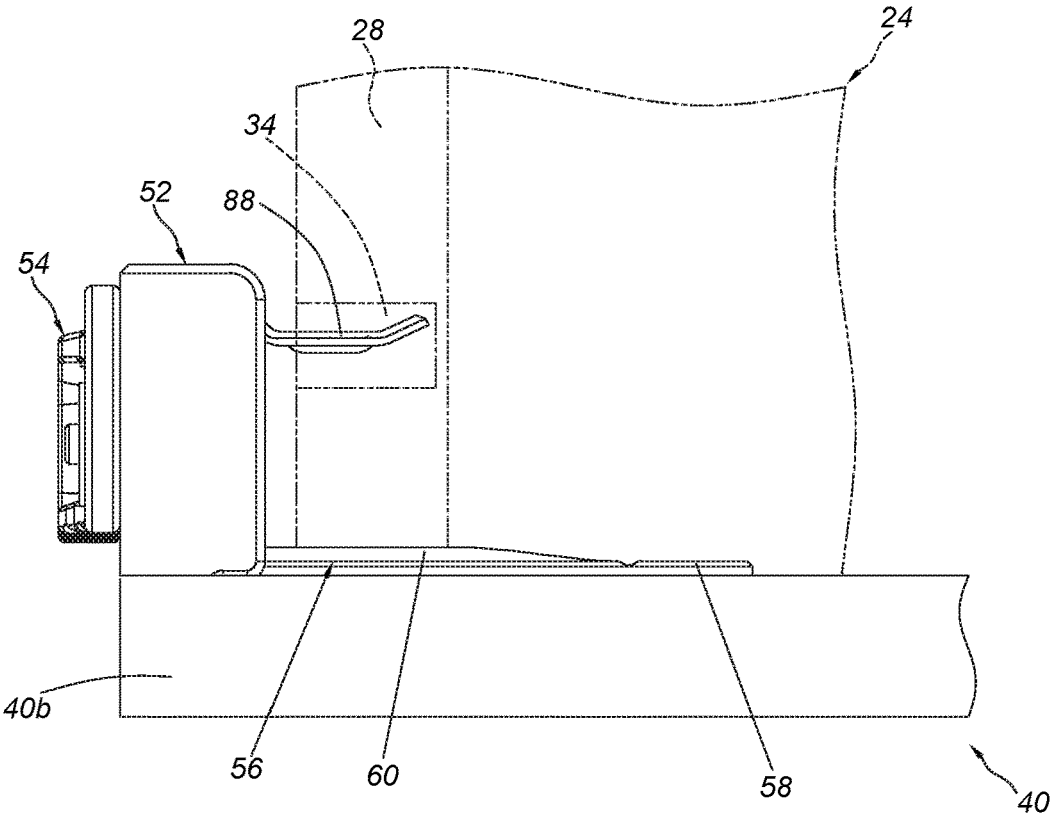
FIG. 10 is a diagram showing the drawer being mounted to a slide rail before a portion of a first base of a first adjusting device being adjusted according to an embodiment of the present invention.

As shown in FIG. 9 and FIG. 10, the adjusting assembly is arranged adjacent to the rear part 40*b* of the second rail 40. Wherein, the first part 58 of the first base 56 is fixed relative to the second rail 40. For example, the first part 58 is fixedly connected to the second rail 40 by riveting or welding.

During an installation process of the drawer 24, a user can use the second adjusting member 82 to adjust the transverse position of the second base 84, in order to align the protrusion part 88 of the second base 84 to the mounting hole 34 of the rear wall 28 of the drawer 24 (or the carried object). Furthermore, when the drawer 24 is mounted to the second rail 40, the protrusion part 88 of the second base 81 to inserted into the mounting hole 31 of the rear wall 28 of the drawer 24, and the second part 60 is configured to support the bottom of the drawer 24.

Figure 11:
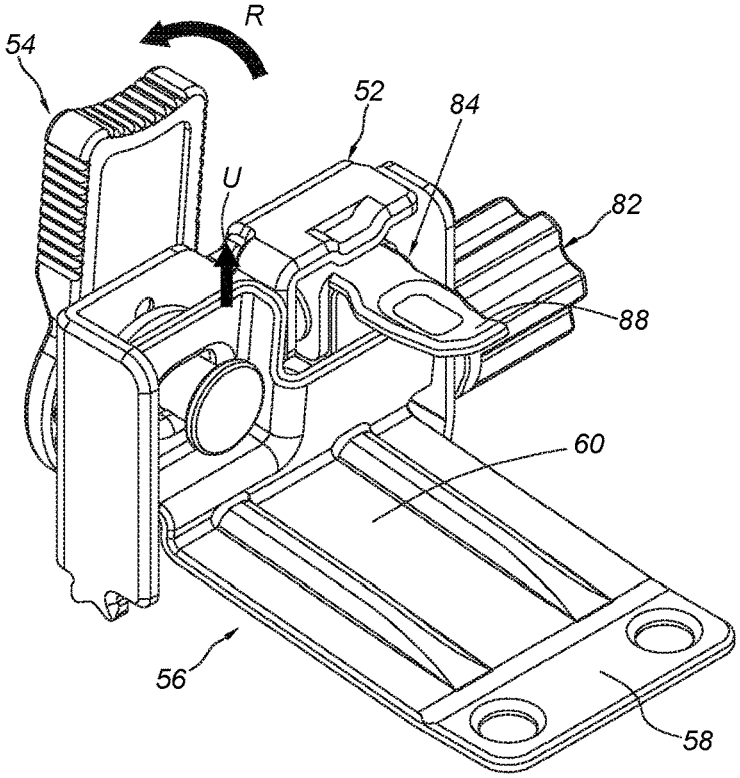
FIG. 11 is a diagram showing a height of the first base of the first adjusting device of the adjusting assembly being adjusted according to an embodiment of the present invention.

As shown in FIG. 11, the user can operate the first adjusting member 54 to rotate relative to the housing 52 along a rotation direction R, in order to adjust the first base 56 to move along a height direction U. In other words, the first adjusting member 54 can be operated to adjust a height of the first base 56.

Figure 12:
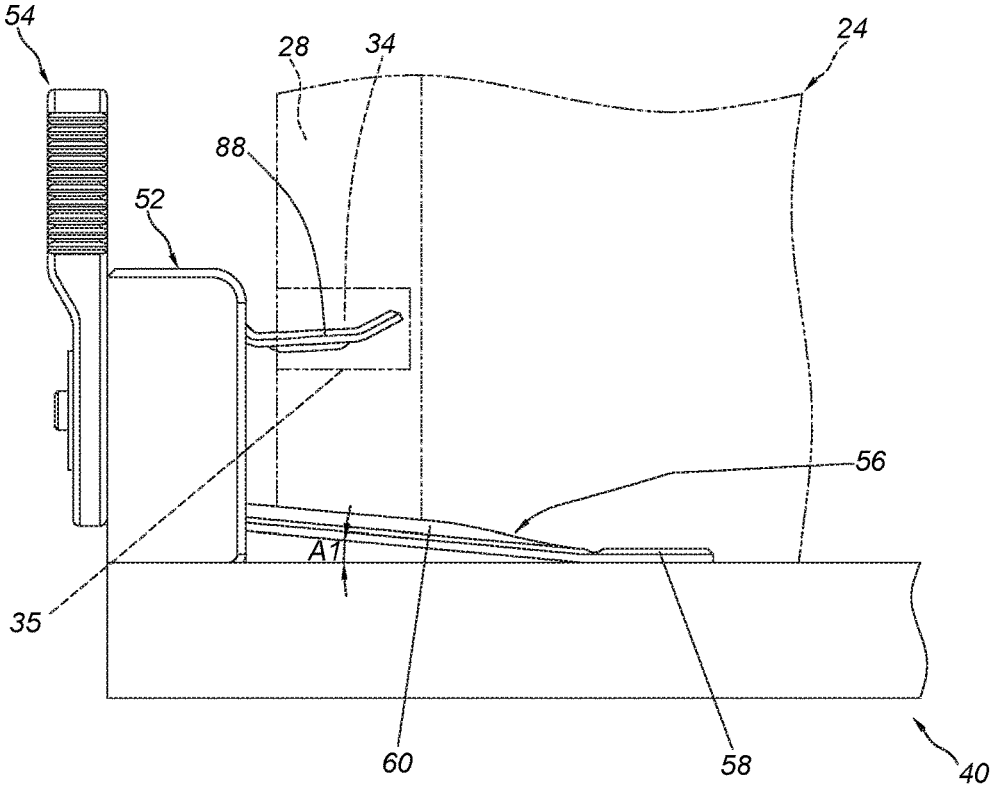
FIG. 12 is a diagram showing the drawer being mounted to the slide rail with the portion of the first base of the first adjusting device being adjusted to change an inclination angle of the drawer according to an embodiment of the present invention.

As shown in FIG. 12, when the user is going to adjust an inclination angle of the drawer 24, the user can use the first adjusting member 54 to adjust an inclination angle of the second part 60 relative to the second rail 40.

Specifically, in the present embodiment, since the first part 58 is fixedly connected to the second rail 40, the inclination angle of the second part 60 relative to the second rail 40 can be adjusted when the user operates the first adjusting member 54 to rotate along the rotation direction R. For example, the inclination angle of the second part 60 relative to the second rail 40 can be adjusted to a first inclination angle A1. In other words, the rear wall 28 of the drawer 24 is obliquely lifted, such that the inclination angle of the drawer 24 is adjusted. Wherein, an inner wall 35 of the mounting hole 34 of the drawer 24 is moved closer to the protrusion part 88 of the second base 84.

Figure 13:
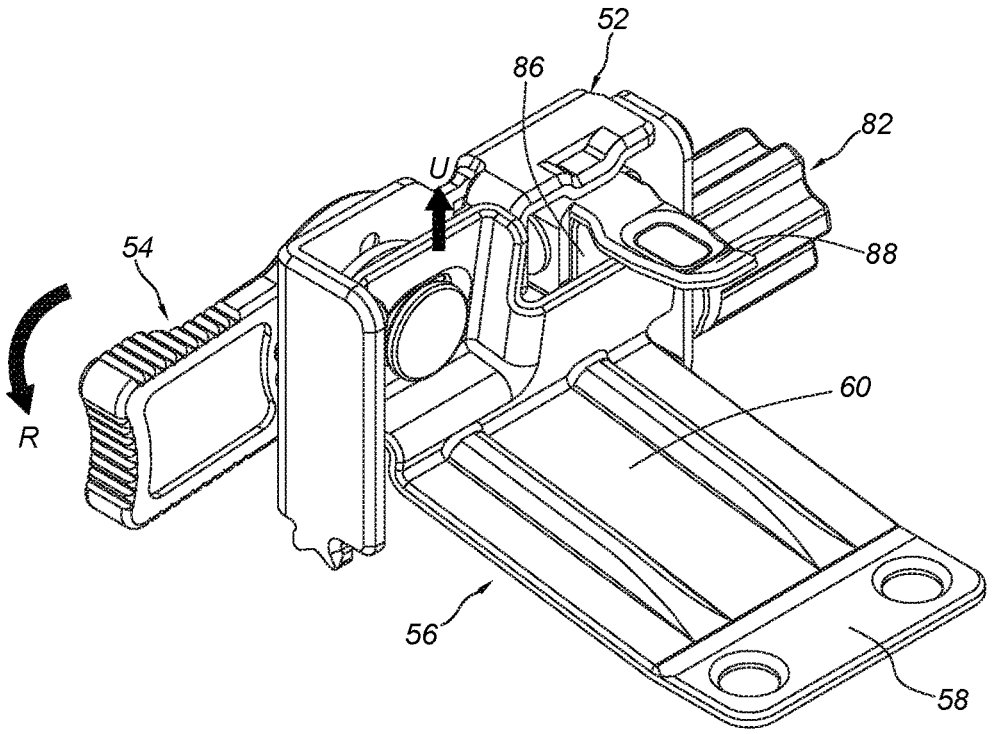
FIG. 13 is a diagram showing the height of the first base of the first adjusting device of the adjusting assembly being further adjusted according to an embodiment of the present invention.

As shown in FIG. 13, the user can further operate the first adjusting member 54 to rotate relative to the housing 52 along the rotation direction R, in order to adjust the first base 56 to further move along the height direction U.

Figure 14:
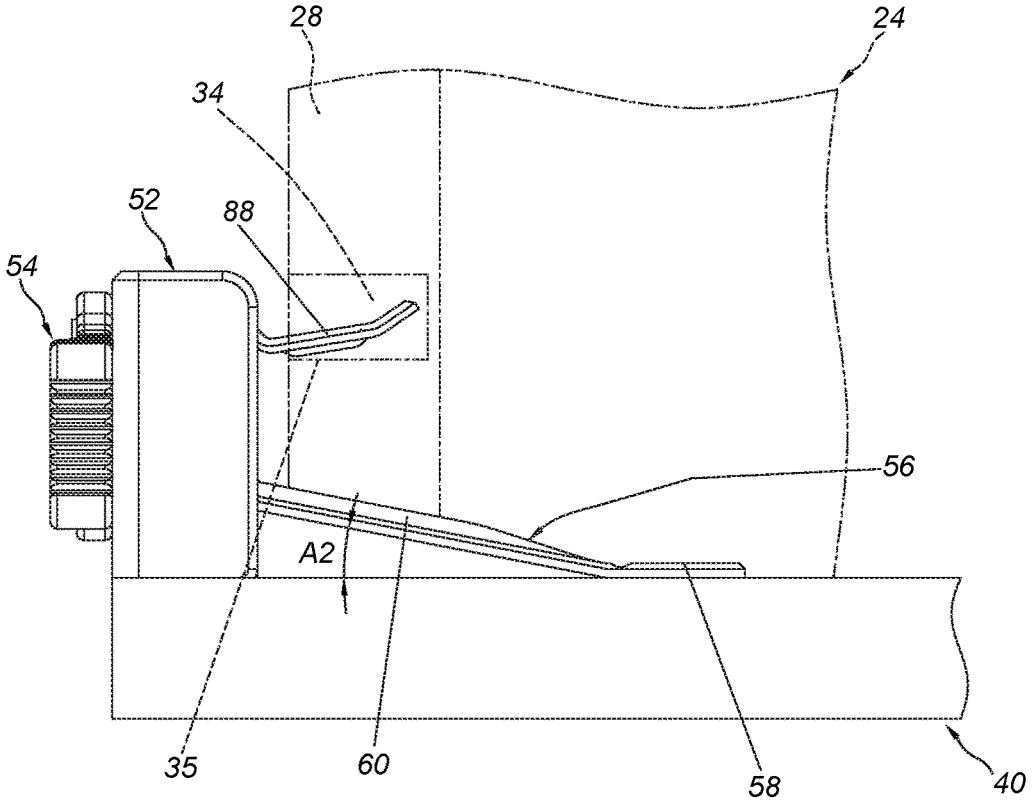
FIG. 14 is a diagram show rig the drawer being mounted to the slide rail with the portion of the first base of the first adjusting device being adjusted to further change the inclination angle of the drawer according to an embodiment of the present invention.

As shown in FIG. 14, when the user is going to further adjust the inclination angle of the drawer 24, the user can use the first adjusting member 54 to further adjust the second part 60, such that the inclination angle of the second part 60 is changed from the first inclination angle A1 to a second inclination angle A2.

Specifically, in the present embodiment, since the first part 58 is fixedly connected to the second rail 40, the inclination angle of the second part 60 relative to the second rail 40 can be further adjusted when the user operates the first adjusting member 54 to further rotate along the rotation direction R. In other words, the rear wall 28 of the drawer 24 is further obliquely lifted, such that the inclination angle of the drawer 24 is adjusted. Wherein, the inner wall 35 of the mounting whole 34 of the drawer 24 is moved further closer to the protrusion part 88 of the second base 84.

Moreover, dimensional tolerances of the mounting hole 34 of the drawer 24 and the protrusion part 88 of the second base 84 may cause two situations. In a first situation, the inner wall 35 of the mounting hole 34 of the drawer 24 may contact the protrusion part 88 of the second base 84. Wherein, since the protrusion part 88 of the second base 84 is fixedly connected to the base part 86, the protrusion part 88 is not moved by the inner wall 35. Or, in a second situation, when a force applied by the user to the first adjusting member 54 is too large, a force applied to the protrusion part 88 from the inner wall 35 may deform the protrusion part 88 to slightly tilt. Therefore, through fixedly connecting the protrusion part 88 to the base part 86, the position of the protrusion part 88 is not easily changed by an external force, so as to increase structural reliability.

The slide rail mechanism and the adjusting assembly for slide rail of the present in are characterized in that:

1. The slide rail mechanism 36 comprises the first adjusting device 44 and/or the second adjusting device 50. Wherein, the first adjusting device 44 is configured to adjust the inclination angle of the furniture part (such as the drawer); the second adjusting device 50 comprises the second base 84 and the second adjusting member 82 configured to adjust the second base 84 to move transversely (or laterally), in order to align the protrusion part 88 of the second base 84 to the mounting hole 34 of the furniture part.
2. Through fixedly connecting the protrusion part 88 to the base part 86, the position of the protrusion part 88 is not easily changed by the external force, such that the structural reliability can be increased.
3. The first part 58 and the second part 60 of the first base 56 are integrally formed in one piece. Through fixing the first part 58 to the second rail 40, the second part 60 can be adjusted to be inclined relative to the second rail 40, in order to adjust the inclination angle of the furniture part (such as the drawer), so as to simplify structure and reduce cost.
4. Through arrangement of the first guiding feature 94 and the second guiding feature 96, the second base 84 can be moved transversely or laterally.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail mechanism, comprising:

a slide rail comprising a front part and a rear part;

a housing connected between the front part and the rear part of the slide rail;

a first adjusting device mounted to the housing, the first adjusting device comprising a first base and a first adjusting member; and a second adjusting device mounted to the housing, the second adjusting device comprising a second base and a second adjusting member;

wherein the first base comprises a first part and a second part connected to the first part, and the first part and the second part are extended along a longitudinal direction of the slide rail;

wherein the first part is fixed relative to the slide rail, and the first adjusting member is configured to adjust an inclination angle of the second part relative to the slide rail;

wherein the second adjusting member is configured to adjust the second base to transversely move relative to the slide rail, the second base comprises a base part and a protrusion part, the protrusion part is fixed to the base part, the protrusion part is configured to be inserted into a mounting feature of a carried object on the slide rail;

wherein the housing comprises a first side plate, a second side plate, a middle plate connected between the first side plate and the second side plate, a bottom plate extended from a bottom of the middle plate, and a spacing plate substantially perpendicularly connected to the bottom plate;

wherein the second base is located within a space defined by the first side plate, the bottom plate and the spacing plate of the housing.

2. The slide rail mechanism of claim 1, wherein the first base further comprises an extension wall substantially perpendicularly connected to the second part, the first adjusting member comprises a main body part and an eccentric part, the main body part and the eccentric part are not concentric, the eccentric part is mounted to the extension wall.

3. The slide rail mechanism of claim 2, wherein the extension wall, the second part and the first part of the first base are integrally formed in one piece.

4. The slide rail mechanism of claim 1, wherein the first part and the second part of the first base are integrally formed in one piece.

5. The slide rail mechanism of claim 1, wherein the first base is made of a flexible material.

6. The slide rail mechanism of claim 1, wherein the second base has a first adjusting structure corresponding to a second adjusting structure of the second adjusting member, in order to allow the second adjusting member to adjust the second base to move transversely.

7. The slide rail mechanism of claim 6, wherein the first adjusting structure and the second adjusting structure are screw structures screwed to each other.

8. The slide rail mechanism of claim 1, wherein the housing is connected to the slide rail and adjacent to the rear part of the slide rail.

9. An adjusting assembly, comprising:

a first adjusting device comprising a first base and a first adjusting member configured to operatively move the first base for adjusting a height of the first base;

a second adjusting device comprising a second base and a second adjusting member configured to adjust the second base to move transversely relative to the first base; and a housing, wherein the first adjusting device and the second adjusting device are mounted to the housing;

wherein the second base comprises a base part and a protrusion part, the protrusion part is fixed to the base part, and the protrusion part is arranged along a longitudinal direction of the first base;

wherein the housing comprises a first side plate, a second side plate, a middle plate connected between the first side plate and the second side plate, a bottom plate extended from a bottom of the middle plate, and a spacing plate substantially perpendicularly connected to the bottom plate;

wherein the second base is located within a space defined by the first side plate, the bottom plate and the spacing plate of the housing.

10. The adjusting assembly of claim 9, wherein the protrusion part has a first supporting section, and the base part has a second supporting section configured to abut against the first supporting section.

11. The adjusting assembly of claim 9, wherein the housing has a first guiding feature, and the second base has a second guiding feature mounted to the first guiding feature.

12. The adjusting assembly of claim 11, wherein one of the first guiding feature and the second guiding feature is a rib, and the other one of the first guiding feature and the second guiding feature is an elongated hole or an elongated groove.

13. The adjusting assembly of claim 9, wherein the first adjusting member comprises a main body part and an eccentric part, the main body part and the eccentric part are not concentric, the eccentric part is mounted to the first base, the second base has a first adjusting structure corresponding to a second adjusting structure of the second adjusting member, in order to allow the second adjusting member to adjust the second base to move transversely, and the first adjusting structure and the second adjusting structure are screw structures screwed to each other.

14. A slide rail mechanism, applicable to a furniture part, the slide rail mechanism comprising:

a first rail;

a second rail longitudinally movable relative to the first rail, the second rail configured to support the furniture part and comprising a front part and a rear part;

a first adjusting device adjacent to the rear part of the second rail, the first adjusting device comprising a first base and a first adjusting member;

a second adjusting device, wherein the second adjusting device comprises a second base and a second adjusting member configured to adjust the second base to move transversely relative to the second rail through screw structures, the second base comprises a base part and a protrusion part, the protrusion part is fixed to the base part, and the protrusion part is configured to be inserted into a mounting hole of the furniture part; and a housing connected to the second rail, wherein the first adjusting device and the second adjusting device are mounted to the housing;

wherein the first base comprises a first part and a second part connected to the first part;

wherein the first part is fixed relative to the second rail, and the second part is configured to support a bottom of the furniture part;

wherein the first adjusting member is configured to adjust an inclination angle of the second part relative to the second rail;

wherein the housing comprises a first side plate, a second side plate, a middle plate connected between the first side plate and the second side plate, a bottom plate extended from a bottom of the middle plate, and a spacing plate substantially perpendicularly connected to the bottom plate;

wherein the second base is located within a space defined by the first side plate, the bottom plate and the spacing plate of the housing.

15. The slide rail mechanism of claim 14, wherein the first base further comprises an extension wall substantially perpendicularly connected to the second part, the first adjusting member comprises a main body part and an eccentric part, the main body part and the eccentric part are not concentric, the eccentric part is mounted to the extension wall.

16. The slide rail mechanism of claim 14, wherein the first part and the second part of the first base are integrally formed in one piece.

17. The slide rail mechanism of claim 14, wherein the first base is made of a flexible material.

18. The slide rail mechanism of claim 14, wherein the housing is connected to the second rail and adjacent to the rear part of the second rail.

* * * * *